US008755957B2

(12) United States Patent
Chenu

(10) Patent No.: US 8,755,957 B2
(45) Date of Patent: Jun. 17, 2014

(54) METHOD FOR SECURING A PILOTING SYSTEM OF A RECONFIGURABLE MULTI-UNIT VEHICLE AND A SECURE PILOTING SYSTEM

(75) Inventor: Eric Chenu, Chaville (FR)

(73) Assignee: Siemens S.A.S., Saint-Denis (FR)

( * ) Notice: Subject to any disclaimer, the term of this patent is extended or adjusted under 35 U.S.C. 154(b) by 0 days.

(21) Appl. No.: 13/989,300

(22) PCT Filed: Sep. 15, 2011

(86) PCT No.: PCT/EP2011/066032
§ 371 (c)(1),
(2), (4) Date: May 23, 2013

(87) PCT Pub. No.: WO2012/069223
PCT Pub. Date: May 31, 2012

(65) Prior Publication Data

US 2013/0245865 A1 Sep. 19, 2013

(30) Foreign Application Priority Data

Nov. 23, 2010 (EP) ..... 10290624

(51) Int. Cl.
*B61L 25/04* (2006.01)

(52) U.S. Cl.
USPC ..... 701/19

(58) Field of Classification Search
None
See application file for complete search history.

(56) References Cited

U.S. PATENT DOCUMENTS

| | | | | |
|---|---|---|---|---|
| 6,144,900 | A * | 11/2000 | Ali et al. | 701/19 |
| 8,274,180 | B2 | 9/2012 | Homma et al. | |
| 2006/0180709 | A1 * | 8/2006 | Breton et al. | 246/1 C |

FOREIGN PATENT DOCUMENTS

| | | | | |
|---|---|---|---|---|
| EP | 10652128 | A1 | 1/2001 | |
| EP | 2213545 | A1 | 8/2010 | |
| GB | 2461386 | A * | 6/2010 | B61L 15/00 |
| WO | 2007/118837 | A1 | 10/2007 | |

OTHER PUBLICATIONS

Hubert Kirrmann—The IEC/IEEE Train Communication Network, pp. 81-92. Published in 2001. Webpage: http://ieeexplore.ieee.org/stamp/stamp.jsp?tp=&arnumber=918005.*

(Continued)

*Primary Examiner* — John R Olszewski
*Assistant Examiner* — Jess Whittington
(74) *Attorney, Agent, or Firm* — Laurence A. Greenberg; Werner H. Stemer; Ralph E. Locher

(57) ABSTRACT

A method for securing a control system and a secured control system of a multi-unit vehicle. The control system has a device for determining a composition of the multi-unit vehicle, that can autonomously determine the composition of the multi-unit vehicle and generate composition data. A calculator for at least one unit of the multi-unit vehicle. Each calculator is connectable to an inlet/outlet set of inlet/outlet modules for at least one unit and to the composition-determining device, in order to exchange operating data of the unit and/or the multi-unit vehicle with each inlet/outlet module, and to acquire data relating to the composition from the determination device. At least one module for dynamically securing the exclusive connection of each calculator to the inlet/outlet set determines, from the composition data, the validity of the inlet/outlet set, and controls, cyclically or sufficiently frequently, a coherence between each connection of each calculator to the inlet/outlet set.

14 Claims, 3 Drawing Sheets

(56) References Cited

OTHER PUBLICATIONS

Hubert Kirrmann—Train Communication Network IEC 61375-3 Multifunction Vehicle Bus. Webpage: http://www.slidefinder.net/i/iec61375__mvb/iec61375-3-mvb/10726686.*

Hubert Kirrmann—Train Communication Network IEC 61375-4 Wire Train Bus. Webpage: http://www.slidefinder.net/i/iec61375__wtb/iec61375-4-wtb/10728550/p3.*

Mueller, R., et al., "Eine automatische U-Bahn Technische Besonderheiten der AGT-Fahrzeuge fuer Nuernberg", 2003, XP01536300.

* cited by examiner

METHOD FOR SECURING A PILOTING SYSTEM OF A RECONFIGURABLE MULTI-UNIT VEHICLE AND A SECURE PILOTING SYSTEM

BACKGROUND OF THE INVENTION

Field of the Invention

The present invention relates to a method for securing a piloting system of a multi-unit vehicle and a secure piloting system of said multi-unit vehicle.

In particular, the present invention relates to the domain of reconfigurable multi-unit vehicles, i.e. vehicles that may be made up of several units, in which the configuration or composition of said units of said multi-unit vehicle is variable, i.e. it can be modified or reconfigured. Preferably, the present invention relates to multi-unit vehicles in which operation of a piloting system, in particular an automatic piloting system, can be correlated to the composition of the multi-unit vehicle.

Said multi-unit vehicle belongs in particular in the railway domain. It may for example be a train that may be made up of several units, for example several cars and/or locomotives coupled successively to one another and forming a first set of cars of said train. The composition of said train, and therefore said first trainset, can therefore be changed, for example by splitting or adding to said first trainset, to form a second trainset including at least some of the units of said first trainset, to which other units may be coupled. Thus, the composition of a multi-unit vehicle may change as a function of a change of an arrangement or distribution of said units forming said multi-unit vehicle, or by respectively adding and/or removing at least one unit respectively to and/or from said multi-unit vehicle.

To guarantee safety in such multi-unit vehicles comprising several units arranged in an order of formation, it is in particular necessary that the data relating to the composition of said multi-unit vehicle, for example the number of units it comprises, the features of said units, the relationships between these units and the coupling thereof to one or more other units, be known by the piloting system used to pilot said multi-unit vehicle. Such piloting systems usually include a processor connected to the input/output modules, in particular enabling operating data relating to the piloting of the multi-unit vehicle to be acquired and sent. The processor is then able to pilot, using the input/output modules, said multi-unit vehicle, in particular in an automatic mode, or in a manual mode in which the piloting system, and therefore the processor, can be controlled by a driver or a control center. Indeed, the operating data are in particular exchanged, via input/output modules, between said processor and the devices included in at least some of the units making up said multi-unit vehicle to operate it. Said exchange of operating data may for example be implemented by means of a two-way connection between the processor and said devices via said input/output modules. The processor and the input/output modules are thus designed to enable and provide for the piloting of the multi-unit vehicle, i.e. the correct operation thereof (movement, stopping, opening doors, etc.), using the composition data of said multi-unit vehicle and the operating data relating to piloting that can be exchanged with said devices of at least some of said units. If the configuration of said multi-unit vehicle is changed (splitting, coupling with other units), said composition data must be updated to ensure that the piloting system, in particular the processor thereof, is informed of said change of configuration and is able to correlate the change of composition of said multi-unit vehicle with a change of the operating data relating to piloting. Indeed, if the processor is not informed of a change of the composition of the multi-unit vehicle, there is a risk of it interpreting the non-receipt of operating data from units that have been unhitched from the multi-unit vehicle (and which can therefore no longer send operating data relating to piloting) as a safety risk for said multi-unit vehicle, which may result in activation of a safety procedure for the multi-unit vehicle, such as emergency braking.

The piloting system of the multi-unit vehicle must in particular be characterized by a high degree of operational safety to prevent any events that could jeopardize the multi-unit vehicle or the passengers or goods transported by said multi-unit vehicle. The safety of such piloting systems may be characterized using safety standards. In particular, standard IEC 61508 defines the security integrity level (SIL) that a system is required to provide to guarantee suitable protection against risks that could occur during operation of said system. The higher the security integrity level, the more the risk is reduced. For example, an SILO safety system provides a risk reduction of between $10^8$ and $10^9$ in continuous operation mode, while this reduction in an SIL1 system is only between $10^5$ and $10^6$.

To guarantee the safe piloting of the multi-guided vehicle, it must be possible to ensure that the processor of the piloting system is perfectly aware of the composition and the configuration of said multi-unit vehicle (for example, which units make up the train and which order of formation has been used to arrange them, i.e. in what order they are coupled together), to enable it to exchange all of the operating data required to pilot the multi-unit vehicle with the units of said multi-unit vehicle.

Moreover, if the composition of the multi-unit vehicle is changed, for example if the train is split into several parts, the processor of the piloting system must be quickly informed of said change of composition, for example to authorize it to ignore any operating data from units that have been unhitched from the train when it was split, so as not to enter a safety state resulting in an alert being issued at a monitoring center of a multi-unit-vehicle network or activation of a safety procedure, such as emergency braking of said multi-unit vehicle.

Unfortunately, the secure (SIL4) piloting systems, both automatic and manual, known to the person skilled in the art are essentially based on "closed" processors for which the input/output scope is not reconfigurable, i.e. the processor is connected to a fixed set of inputs/outputs of input/output modules and, since these inputs/outputs permanently connect the processor to specific functional devices of the units managed by said processor, they are not reconfigurable if the configuration of the multi-unit vehicle is changed. Functional device means any device interacting with the piloting system to enable said multi-unit vehicle to be piloted. These may be for example braking devices, door opening devices, devices for enabling or monitoring movement of said multi-unit vehicle, etc. The management of a multi-unit vehicle usually uses several processors each managing one part of the multi-unit vehicle, each processor being connected to inputs/outputs connecting them permanently to certain functional devices of the unit or units it manages. Although the composition of the multi-unit vehicle is therefore known by cross-checking information coming from each processor, this piloting-system concept has the disadvantage of having to manage functions spread over different processors, in particularly requiring algorithms to synchronize said processors, the complexity of which increases with the number of units in the multi-unit vehicle.

Currently, the composition or makeup of a multi-unit vehicle is therefore generally determined by crosschecking application data exchanged between the different processors of said vehicle. This application data is data from other devices on the multi-unit vehicle the primary task of which is not necessarily determining the composition of said multi-guided vehicle. This is for example location data of the front and back of the multi-unit vehicle sent to the processor by on-board or ground positioning devices, or data on the coupling state of the units, or lists of multi-unit vehicles sent to the processor by an automatic pilot on the ground and not on board said multi-unit vehicle. Crosschecking this application data has the drawback of being complicated and slow, thereby reducing the piloting efficiency of said multi-unit vehicle. Indeed, the complexity of exchanging application data between processors generates a loss of performance in the piloting system, and complicates implementation of said piloting system, making it more difficult to demonstrate and ensure the safety of said piloting system. Moreover, this application data may be different from one project to the next, which has a detrimental effect on the genericity of the algorithms.

BRIEF SUMMARY OF THE INVENTION

One object of the present invention is to propose a method for securing a system for piloting a reconfigurable multi-unit vehicle and a secure piloting system that are simple, safe, reliable and efficient, that support automatic, independent updating of a composition of a multi-unit vehicle, while supporting SIL4. Indeed, the object of the present invention relates to the automatic determination and updating of the composition of a multi-unit vehicle, regardless of application data, in order to guarantee the safety of the piloting system of the multi-unit vehicle.

For this purpose, a method for securing a piloting system, a secure piloting system and a device to help determine the composition of a multi-unit vehicle are proposed by the content of the claims. A set of sub-claims also sets out the advantages of the invention.

The present invention proposes a method for securing a piloting system intended to be fitted to and to pilot a reconfigurable multi-unit vehicle, including in particular at least two units that can be coupled together in sequence, said method being characterized in that it includes:

- independent determination, preferably cyclical and automatic, of a composition of a multi-unit vehicle by a device for determining the composition of said multi-unit vehicle correlated to generation, preferably by said determination device, of a composition datum of said multi-unit vehicle;
- transmission, preferably cyclical and automatic, of said composition datum to a set of elements of the piloting system, at least one element of said elements of said set of elements being a processor of said piloting system;
- determination, preferably cyclical and automatic, by said processor using said composition datum, of a set of inputs/outputs of at least one input/output module intended to be fitted to the multi-unit vehicle, said input/output module being fitted for example to a unit of said multi-unit vehicle and enabling communication and exchange of data between the processor and the functional devices of said unit, in particular to check them and to ensure they are operating correctly;
- a connection of each element of said set of elements, and therefore of said processor, to said set of inputs/outputs, in particular each element of said set of elements can be connected to each input/output of said set of inputs/outputs.

The present invention also proposes a secure piloting system, preferably automatic, of a reconfigurable multi-unit vehicle, comprising for example at least two units that can be coupled to one another in sequence, characterized in that said system includes:

- a device for determining a composition of the multi-unit vehicle, that can independently determine said composition of the multi-unit vehicle and generate a composition datum that can be correlated with said composition of said multi-unit vehicle, said determination being in particular independent in that it is independent of any application data;
- at least one processor comprising at least one securing module, said processor being designed to be fitted to at least one unit of the multi-unit vehicle, each processor being connectable by means of at least one connection and via a network, firstly to a set of inputs/outputs of input/output modules intended to be fitted to one or more units, and secondly to said device for determining the composition of the multi-unit vehicle, in order to exchange, via each input/output module, operating data on the unit and/or the multi-unit vehicle, and in order to acquire from said determination device a composition datum on said multi-unit vehicle, said network being in particular designed to enable communication between each identity generation device and each processor, between each processor and each input/output module, and between each processor;
- said dynamic securing module of said connection of each processor with said set of inputs/outputs, said securing module being designed to be fitted to at least one processor, and being able to determine, using said composition datum, said set of inputs/outputs that can be connected to each processor, to connect each processor to said set of inputs/outputs, in particular to each input/output of said set of inputs/outputs, and to check, cyclically or sufficiently frequently (for example, at least one check per time slot not exceeding 100 milliseconds), consistency between each connection of each processor to said set of inputs/outputs, in particular consistency between each connection of each processor with each of said inputs/outputs of said set of inputs/outputs and said composition datum. In particular, each processor may include a securing module according to the invention.

In other words, the method according to the invention is a method, preferably automatic and in particular including SIL4 securing, for securing a system for piloting a multi-unit vehicle that can reliably determine, at any time, the composition of the multi-unit vehicle and guarantee, at any time, consistency between the composition of the multi-unit vehicle and the operating data of the piloting system of the multi-unit vehicle, by associating at least one processor with said set of inputs/outputs, which can be correlated to said composition of the multi-unit vehicle. Advantageously, the method according to the invention is in particular characterized by cyclical checks, in particular at random or fixed frequencies but in all cases sufficiently frequently (for example, at least one check every time slot not exceeding 100 milliseconds), in particular using the securing module, of consistency between the connection of each element of said set of elements with said set of inputs/outputs and said composition datum.

In particular, the present invention is characterized in that said set of elements includes or is a processor group that can be distributed to each unit of said multi-unit vehicle. In other words, the piloting system according to the invention preferably includes said processor group, which may comprise several identical processors, it being possible in particular to distribute each processor to a unit of the multi-unit vehicle, such that each unit can be fitted with at least one processor. Advantageously, the securing module according to the invention is in particular able to exclusively attribute the connection to said set of inputs/outputs, in particular to each input/output of said set of inputs/outputs, to a single processor of said processor group, the other processors of said processor group being excluded from said connection, i.e. prevented from accessing said set of inputs/outputs. For this purpose, the method according to the invention may include a mechanism for securing and prioritizing the connection of at least one processor of said processor group with said set of inputs/outputs, that is able to exclusively attribute said connection to said set of inputs/outputs to said processor. The processor chosen, i.e. the processor with exclusive access to the set of inputs/outputs, is referred to as the master processor. Advantageously, at least one other processor of said processor group can in particular be associated to the master processor as a redundant processor of said master processor. The piloting system according to the invention is in particular able not only to select a master processor from the processor group, but also to identify a redundant processor from said processor group. The redundant processor is able to perform the same operations as the master processor, to acquire the same composition and operating data as the master processor for checking and securing the piloting system. In the event of failure of the master processor, the redundant processor is able to replace said master processor and to identify a new redundant processor.

Preferably, said securing and prioritization mechanism includes generation of an encoded association token able to lock said connection of at least one processor of said processor group with said set of inputs/outputs, and generation of an unlocking key able to unlock said connection of at least one processor of said processor group with said set of inputs/outputs. For this purpose, at least one processor of the piloting system can in particular be fitted with a securing module including a locking module able to lock each connection of the processor with each of the inputs/outputs of said set of inputs/outputs. This locking module includes in particular an encoded association token generator able to generate, in particular cyclically, firstly said encoded association token in order to lock each connection of said processor with each of the inputs/outputs of said set of inputs/outputs, and secondly said unlocking key able to unlock at least one connection of said processor with at least one of the inputs/outputs of said set of inputs/outputs.

Furthermore, the method according to the invention is in particular characterized in that said independent determination includes a successive and ordered addition to a list, in an order of composition of said multi-unit vehicle, of at least one identity datum of each unit of said multi-unit vehicle, such that an order of succession of identity data included in said list can be correlated with the order of composition of the units of said multi-unit vehicle, each identity datum being specific to a single unit of the multi-unit vehicle, and it being possible to encapsulate said list within said composition datum. In particular, the identity datum includes at least one time datum, one unit identifier, one encoding constant, and at least one identifier of a device of said unit.

Preferably, the piloting system according to the invention is in particular characterized in that the device it uses to determine a composition of the multi-unit vehicle includes at least one identity generation device, each identity generation device of the determination device being intended to be fitted to a unit of the multi-unit vehicle, such that each unit can be fitted with a single identity generation device, each identity generation device being able to generate the identity datum of the unit it is fitted to. Furthermore, the method according to the invention is also in particular characterized by each unit of said multi-unit vehicle being fitted with said identical identity generation device able to generate said identity datum, which is used to determine the composition of said multi-unit vehicle, such that each unit of the multi-unit vehicle can include an identical identity generation device, each identity generation device being connectable or couplable to at least one other identity generation device such as to form a chain of identity generation devices, each fitted to a unit of said multi-unit vehicle and coupled to one another in sequence.

In particular, said identity generation device, which is firstly intended to enable determination of a composition of the multi-unit vehicle comprising at least one unit, and secondly able to be fitted to said piloting system of said multi-unit vehicle, is characterized in that it includes:

- an identity data generator able to generate said identity datum of the unit to which the identity generation device is to be fitted, said identity datum being intended to enable identification of said unit;
- a connection detector able to detect the presence or absence of the coupling of said identity generation device to at least one other identity generation device;
- a list generator able to create a list of elements intended to include elements that can be ordered and added successively;
- a serialization component able to add another element to said list, either after a last element of a list of elements that can be ordered successively and that is designed to be received by said identity generation device, or as the first element of the list of elements that can be created by the list generator, said other element including said identity datum;
- a list transmitter able to send said list of elements including said other element either to another identity generation device, or to at least one processor, including in particular said securing module of the piloting system of the multi-unit vehicle, following encapsulation of said list within a composition datum of said multi-unit vehicle.

Preferably, the composition of the multi-unit vehicle is determined using said identity generation device using the following steps:

- generation by each identity generation device of each unit of the multi-unit vehicle of said identity datum intended to enable identification of the unit to which said generation device is fitted, said generation being performable by said identity data generator;
- detection, by said connection detector, for each identity generation device, of the presence or absence of the coupling of said identity generation device to at least one other identity generation device;
- in the event of detection for at least one identity generation device of said multi-unit vehicle of said presence of a coupling with only one other identity generation device that can be coupled to it, said method according to the invention includes the following sub-steps:
  - a. creation, by said list generator of said identity generation device characterized by said presence of a coupling with a single other identity generation device, of a list of elements intended to include the successively orderable elements, said list including a first element, said first element including said identity datum of the unit intended to be fitted with said identity generation device characterized by said presence of a coupling with one other identity generation device only, said first element being the first element in the list created by the list generator, said creation being followed by transmission of said list by the identity generation device characterized by said presence of a coupling with only one other identity generation device to said other identity generation device;

b. for each identity generation device for which said detection is able to detect said presence of coupling with two other identity generation devices, receipt of said transmissible list by one of the two other identity generation devices, addition to said list of another element after the last element of said list and transmission of said list to the other of the two other identity generation devices, said other element including the identity datum of the unit intended to be fitted with said identity generation device for which said detection is liable to detect said presence of coupling with said two other identity generation devices; and c. for each receipt of said list by an identity generation device for which said detection is able to detect said presence of coupling with only one other identity generation device, said receipt is followed by said addition to said list of a final element after the last element of said list, then by encapsulation of said list in said composition datum;

in case of detection, for an identity generation device, of said absence of coupling with another identity generation device, said method according to the invention includes creation, by the list generator of said identity generation device characterized by said absence of coupling with another identity generation device, of a list of elements intended to include the successively orderable elements, said list including a first element, said first element including said identity datum of the unit intended to be fitted with said identity generation device characterized by said absence of coupling with another identity generation device, said first element being the first element in the list created by the list generator, said creation being followed by encapsulation of said list in said composition datum;

Thus, the composition of the multi-unit vehicle can be determined using a device inside the piloting system, i.e. using the identity generation device or devices of the device for determining the composition of the multi-unit vehicle, independent of any other devices outside the piloting system used to acquire said application data. Each identity generation device fitted to each of the units of the multi-unit vehicle is therefore connectable to one or two identical identity generation devices such as to form a chain of identity generation devices that can pass said list successively from device to device. In particular, each identity generation device includes at least two connectors, respectively a first and a second connector, each intended to couple said identity generation device to another identity generation device, i.e. one of the neighboring devices in said chain of identity generation devices.

Said list may be created by the list generator of one of the two, or both, identity generation devices located at the end of said chain, provided that the multi-unit vehicle includes more than two units. The device for determining said composition also includes as many identity generation devices as there are units in the multi-unit vehicle. Each of these identity generation devices can generate the identity datum of the unit it is fitted to and send said list to one of the neighboring devices thereof once said list has been sent to it by the other neighboring device thereof. Only the identity generation devices located at the end of the chain and having only one neighbor, i.e. the identity generation devices for which a coupling with only one other identity generation device is detected, are authorized to generate the list and/or to encapsulate a list received from the only neighbor thereof in said identity datum, so that said list can be sent, at the end of the chain, to at least one securing module of at least one processor of the piloting system using said composition datum.

Advantageously, said list generator is in particular able to create said list cyclically. Preferably, said list generator is able to create said list when said connection detector detects said presence of a coupling of said identity generation device with a single other identity generation device or with no other identity generation device. Thus, the creation of said list by the list generator of at least one of the identity generation devices located at the end of the chain, makes it possible to check and continuously update the composition of the multi-unit vehicle if this latter is made up of at least two units, given that said list can be continually sent to the processor via said composition datum once said list has passed through the entire chain of identity generation devices. Equally, the creation of said list by the list generator of an identity generation device coupled with no other identity generation device enables the composition of the multi-unit vehicle to be checked and updated continuously if said multi-unit vehicle is made up of a single unit. Furthermore, said identity data generator is in particular able to generate a polarization datum that can authorize the transmission of said list of elements using just one of the two connectors of said identity generation device, such that said list passes through said chain of identity generation devices in a prioritized direction defined by said polarization.

According to the present invention, each unit comprising said piloting system can be independent, i.e. it can move and manage its own movement and operation independently of any other piloting system outside said unit. Furthermore, the piloting system which can be associated with an independent unit is able to control and manage the movement of any other units coupled to it, provided these other units include at least one other independent unit and/or at least another non-independent unit. A non-independent unit, unlike said independent unit, is a unit that includes only a part of the piloting system, in particular at least one identity generation device, each of these devices being connectable to the network of said unit, itself connectable to the network of other units that can be coupled to it in order to form the network of the multi-unit vehicle. Accordingly, in the remainder of the document, an independent unit shall be able to carry on-board said piloting system according to the invention, and a non-independent unit shall refer to a unit that is not carrying on-board the whole of said piloting system.

A multi-unit vehicle can therefore be formed by at least one independent unit that can be coupled, or otherwise, to one or more independent or non-independent units. In all cases, a processor of one of the independent units shall in particular be responsible for managing the piloting and operation of the multi-unit vehicle. Preferably, the master processor of one of the independent units is intended to pilot the multi-unit vehicle. The master processor intended to pilot said multi-unit vehicle can be designated automatically as a function for example of the order of formation of the multi-unit vehicle deduced from said composition datum, which can be acquired by each processor from each unit. The securing module of the piloting system is firstly able to connect each processor to said set of inputs/outputs to enable an exchange of operating data between each processor and the operating devices of the units of the multi-unit vehicle, but also, secondly, to prioritize the connection of said master processor designated automatically to said set of inputs/outputs and to link a redundant processor to it. Prioritizing in particular means exclusively attributing the connection with said set of inputs/outputs to a processor, preferably to a single processor, for example said master processor, or potentially said master processor with the redundant processor thereof. The set of inputs/outputs of the input/output modules of the secure piloting system makes it possible to connect each processor of the multi-unit vehicle to the functional devices of said multi-unit vehicle via the network of the multi-unit vehicle, said network being common to all of the processors of the multi-unit vehicle. Thus, composition and operating data can be easily and quickly centralized in a single processor, i.e. said master processor, via said network, so that it can be processed, which has the advantage of guaranteeing speedy processing.

Thus, for a multi-unit vehicle comprising several independent units, the piloting system according to the invention is able to select at least one processor from the set of processors distributed over the network of said vehicle to act as master processor intended to be linked directly, by connection to said set of inputs/outputs, to the input/output modules of said vehicle in order to pilot it, for example automatically. When the processor acting as master processor is piloting said vehicle, the other processors of said vehicle may in particular be in standby mode, such that only the processor chosen as master processor by the securing module is controlling the piloting of said vehicle.

The present invention can be better understood through the exemplary embodiments and applications provided using the figures below.

DESCRIPTION OF THE INVENTION

Figure 1:
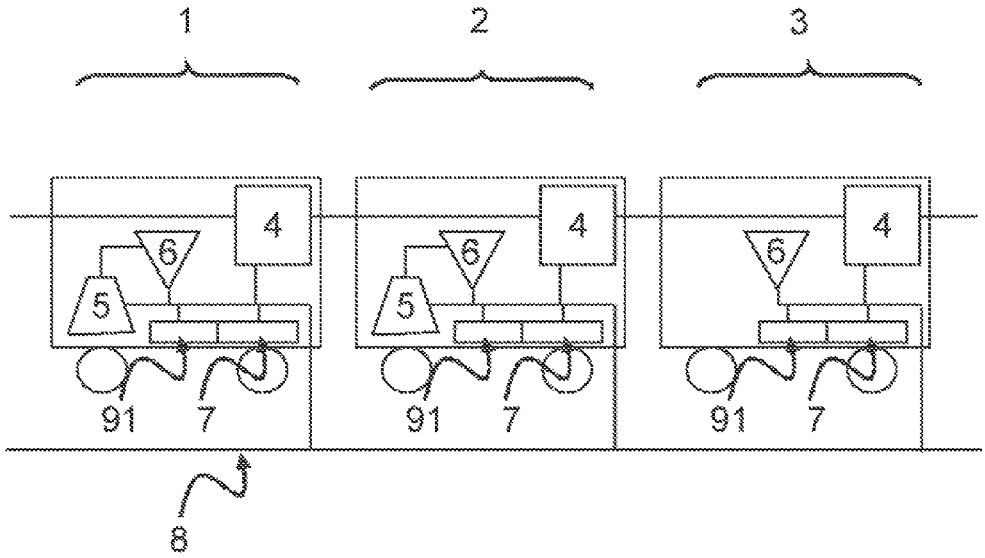
FIG. 1 Exemplary embodiment according to the invention of a secure piloting system.

By way of example, FIG. 1 shows a secure piloting system designed to pilot a reconfigurable multi-unit vehicle having three units 1, 2, 3. The piloting system includes at least one identity generation device 4, each identity generation device 4 being designed to be fitted to a unit 1, 2, 3. Thus, each unit 1, 2, 3 can incorporate said identity generation device 4. Each identity generation device 4 can be connected to the neighbors thereof to form a chain of identity generation devices. Said chain of identity generation devices that are connectable to one another in sequence forms said device for determining a composition of the multi-unit vehicle according to the invention. Said secure piloting system also includes at least one processor 5 intended to be fitted to each independent unit 1, 2 of the multi-unit vehicle and at least one input/output module 91, at least one of said processors 5 of the secure piloting system including at least one securing module 6, potentially incorporated into the processor 5. In particular, several processors 5 are distributed among several independent units 1, 2, and several input/output modules 91 are distributed among several units, whether they are independent or non-independent. A network 8 of the multi-unit vehicle makes it possible to connect the processors 5, the securing modules 6, the device for determining the composition of the multi-unit vehicle, the input/output modules 91, and the functional devices 7 of each unit to one another so that they can communicate and exchange information, such as composition data and operating data, with one another. In particular, the input/output modules 91 of the piloting system enable the connection, via the network 8, of the processors to a set of inputs/outputs, each input/output being able to connect at least one functional device 7 to at least one processor 5. Each processor 5 is in particular dynamically reconfigurable on the basis of the composition datum provided by the device for determining the composition of the multi-unit vehicle, in order to maintain a real-time connection with said inputs/outputs that is consistent with the composition of said multi-unit vehicle.

Figure 2:
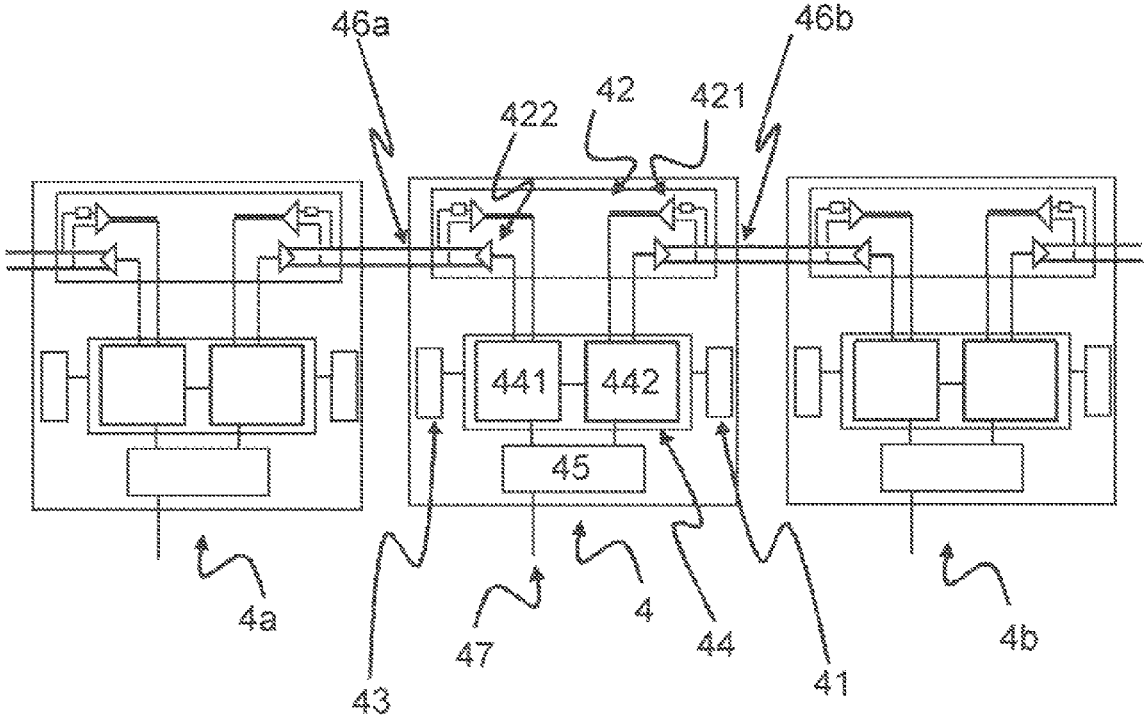
FIG. 2 Exemplary embodiment according to the invention of an identity generation device.

FIG. 2 is an exemplary embodiment of an identity generation device 4 according to the invention. Each identity generation device 4 can be connected, in particular by means of a low speed serial two-way differential connection, to at least one other identical identity generation device 4*a*, 4*b*, in particular to two other identical identity generation devices 4*a*, 4*b* as shown in FIG. 2. Each identity generation device 4, 4*a*, 4*b* includes an identity data generator 41, a connection detector 42, a list generator 43, a serialization component 44, a list transmitter 45, and at least two connectors, respectively a first connector 46*a* and a second connector 46*b*, intended to acquire and send the list. A third connector 47 may in particular connect the identity generation device to the network of the unit or of the multi-unit vehicle.

Furthermore, the connection detector of the identity generation device is in particular characterized in that it is able to securely guarantee that a list inputted via the first connector 46*a* or respectively the second connector 46*b* and intended to be acquired by said identity generation device cannot be found, by crosstalk or any other coupling, on the second connector 46*b* or respectively the first connector 46*a*. For this purpose, the connection detector, which can be coupled to said connectors 46*b*, 46*a*, may in particular include at least one electrically isolated differential buffer, in particular a first buffer 422 connectable to the first connector and a second buffer connectable to the second connector, as well as opto-isolator receivers, in particular a first opto-isolator receiver connectable to the first connector and a second opto-isolator receiver 421 connectable to the second connector. Components intended to protect against interference and overvoltage may be added to said detection device, along with filters to ensure safe isolation between the first and second connectors 46*a*, 46*b*.

Preferably, said serialization component 44 may include two separate digital components 441, 442, for example FPGAs, that can serialize and de-serialize an element of said list, as well as add another element after the last element of said list, in particular in order to safely guarantee that a list cannot pass through the identity generation device of the connector 46*a* to the connector 46*b*, or vice versa, without incorporating the identity datum of said identity generation device.

Furthermore, the identity data generator 41 is in particular able to generate a polarization datum, said polarization datum potentially enabling the list incorporating said identity datum to be propagated only to one of said first or second connectors 46*a* or 46*b*. Finally, said identity datum may advantageously include other information enabling identification of the unit it is attributed to, such as an equipment number or a unit number of the unit it is attributed to. The list transmitter 45 is able to act as an interface between the network, for example an Ethernet IP network, of the multi-unit vehicle and the identity generation device. For this purpose, it may also include a digital component, such as an FPGA programmable logic device.

In the case of a multi-unit vehicle with n units, numbered successively according to the order of formation of said multi-unit vehicle from 1 to n, the value 1 characterizing the unit positioned at one end of the multi-unit vehicle and the value n characterizing the unit positioned at the other end, an example list that could be created by successively adding the identity datum characterizing each unit making up said multi-unit vehicle is given by:

$$\text{List}=H1\cdot\tau^{2n+1}+\tau^{2n}\cdot Id_1+\tau^{2n-1}\cdot Id_2+\ldots+\tau^{2(n-i+1)}\cdot Id_i+\ldots+\tau^{2}\cdot Id_n$$

$$\text{with } Id_i=pol_i+Data_i/\tau \text{ for } i=1,\ldots,n$$

and where

H1 is a time datum characterizing the creation of the list;

$\tau$ is an encoding constant of sufficiently high value expressed, for example, by 48 data bits, to guarantee the objective of SIL5 security, such that the $\tau^i$ sequence has a pseudo-random distribution;

$Id_i$ is the identity datum of unit i of the multi-unit vehicle;

$pol_i$ is a datum characterizing the polarity of the unit i, the polarity indicating simply whether unit i is coupled in forward movement or reverse movement to unit i−1;

$Data_i$ is a datum characterizing at least one device of unit i or an identification number of unit i.

The piloting system according to the invention is therefore able to guarantee that at least one processor, preferably the master processor, is associated consistently with all of the functional devices of the multi-unit vehicle to guarantee the piloting of said multi-unit vehicle. The device for determining the composition of the multi-unit vehicle makes it possible to determine said composition by propagation of said list from one unit to another unit making up said multi-unit vehicle. On the basis of the composition datum able to encapsulate said list, the securing module associates, preferably exclusively, a connection to a set of inputs/outputs distributed on the network of said multi-unit vehicle with a processor, in particular with a master processor, said inputs/outputs being intended to connect said processor to said functional devices of the units that make up said multi-unit vehicle. Preferably, each processor is coupled to a securing module according to the invention, and each securing module according to the invention is able, as a function of said composition datum, to enter an inactive mode or an active mode, such that only one securing module is active for the multi-unit vehicle. In particular, at least one predefinable condition in each of said securing modules enables each of the securing modules to determine its own operating mode, i.e. either said active mode, or said inactive mode. Said predefinable condition may for example be correlated to a position, within the multi-unit vehicle, of the unit fitted with a processor including said securing module.

Figure 3:
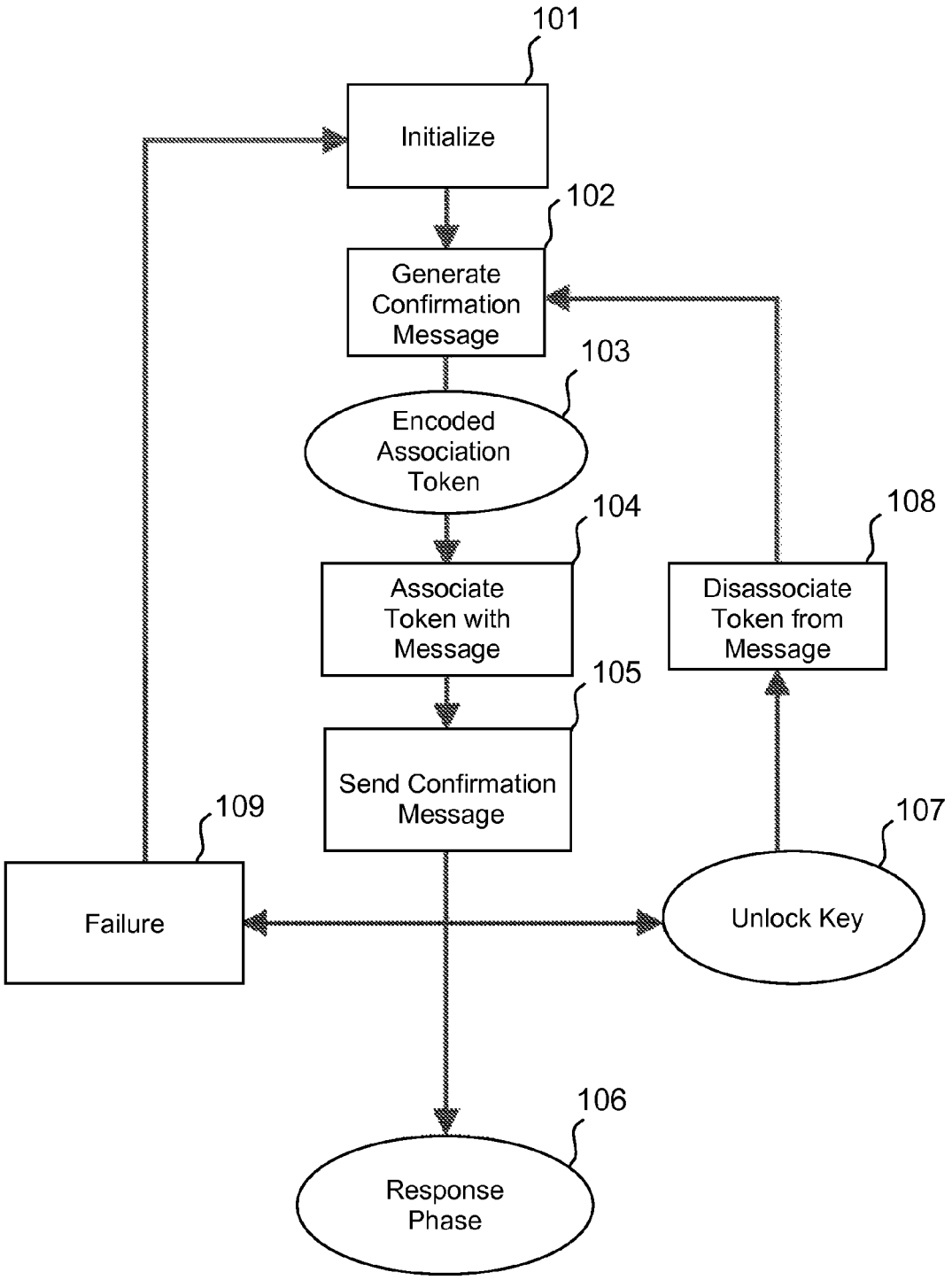
FIG. 3 Example securing mechanism of a securing and prioritization module according to the invention.

FIG. 3 shows an example mechanism for securing the association of at least one processor of a piloting system according to the invention with a set of inputs/outputs of input/output modules intended to be fitted to the multi-unit vehicle. Once the composition datum of the multi-unit vehicle has been created, the method according to the invention is characterized in that a securing module is chosen, for example as a function of said composition datum, in order to secure the connection of a processor or of a processor group, for example a master processor and the redundant processor thereof, with a set of inputs/outputs of input/output modules. For this purpose, the securing module includes in particular an encoded association token generator able to generate an encoded association token comprising in particular a specific identification code of the processor or of the processor group authorized to be connected to the inputs/outputs of said input/output modules. The locking module of the securing module is in particular able to send said token to all of the input/output modules in which the inputs/outputs are intended to be connected to said processor or processor group to remain consistent with said composition datum of the multi-unit vehicle, and to enable the processor or processor group to check the functional devices of the multi-unit vehicle. Said composition datum in particular enables the securing module to determine which inputs/outputs of which input/output modules need to be checked by the processor or processor group in order to ensure operation of the multi-unit vehicle, and therefore to determine which inputs/outputs must be connected to said processor or processor group.

Each input/output module receiving said encoded association token is in particular able, during a response phase, to send, periodically or sufficiently frequently, a confirmation message able to confirm the connection of said processor with the inputs/outputs of said input/output module, and to send said confirmation message to said processor, in particular to said securing module of said processor of the secure piloting system. Said confirmation message may for example be sent periodically at a transmission period having a predefinable time value, i.e. duration. Advantageously, the response phase may be preceded by an initialization phase 1 enabling the generation and initialization of the confirmation message. The duration of this initialization phase is in particular greater than the duration of said transmission period in order to safely guarantee that the securing mechanism has time to detect that a processor or a processor group previously connected to an input/output of an input/output module has lost said connection with said input/output before another processor or another processor group has had time to connect to said input/output. This duration of the initialization phase that is longer than the transmission period may for example be guaranteed by a pseudo-random generator obliged to operate continuously during said initialization phase of the confirmation message.

Thus, at the end of the initialization phase 101, an initialized confirmation message 102 is generated by the input/output module. At the time of receipt 103 of an encoded association token sent by the securing module of the piloting system, the input/output module is able to associate, during an association phase 104, said encoded association token with said initialized confirmation message. At the end of said association phase, said confirmation message 105 is ready to be sent periodically to the securing module. Advantageously, this confirmation message, after said association phase, includes said identification datum of the processor or processor group, as well as identification of the inputs/outputs of the input/output module connected to said processor or processor group, and a time datum in order to check that the confirmation message is current. The confirmation message is then sent, in particular cyclically, during the response phase 106, at least to said securing module that sent the encoded association token. The locking module of said securing model is in particular able to decode the confirmation message in order to check that the inputs/outputs of said input/output module are connected to said processor or to said processor group, and not to other processors.

Advantageously, while an input/output module is connected to a processor or processor group via the inputs/outputs thereof, said input/output module generates, in particular cyclically, at said transmission period, said confirmation message and no other processor can be connected to it. In order to release the input/output module from the connection thereof with a processor or processor group, the association token generator of said locking module is able to generate an unlocking key to be sent by the locking module to all of the input/output modules with connections to the processor or the processor group that are to be cut. On receipt of such an unlocking key 107, the input/output module is in particular able to disassociate the encoded association token from the initialized confirmation message at 108 in order to restore said initialized confirmation message 102.

In the event of failure 109, for example in the event of a loss of connection or communication with the securing module or the processor, the input/output module is able to reset itself by returning to the initialization phase of the confirmation message to authorize, for example, an encoded association token from another processor to be associated with said initialized confirmation message.

The response phase 106 enables the confirmation to be sent, in particular cyclically, to the securing module via said confirmation message, confirming that the inputs/outputs of said input/output module are connected and checked by the processor, for example the master processor, or by a processor group, for example the master processor and the redundant processor thereof. Said securing module is then in particular able to continuously check consistency of the connection of the processor with each input/output module for which it has received said confirmation message and said composition datum, thereby guaranteeing the secure connection of a processor to said set of inputs/outputs.

Figure 4:
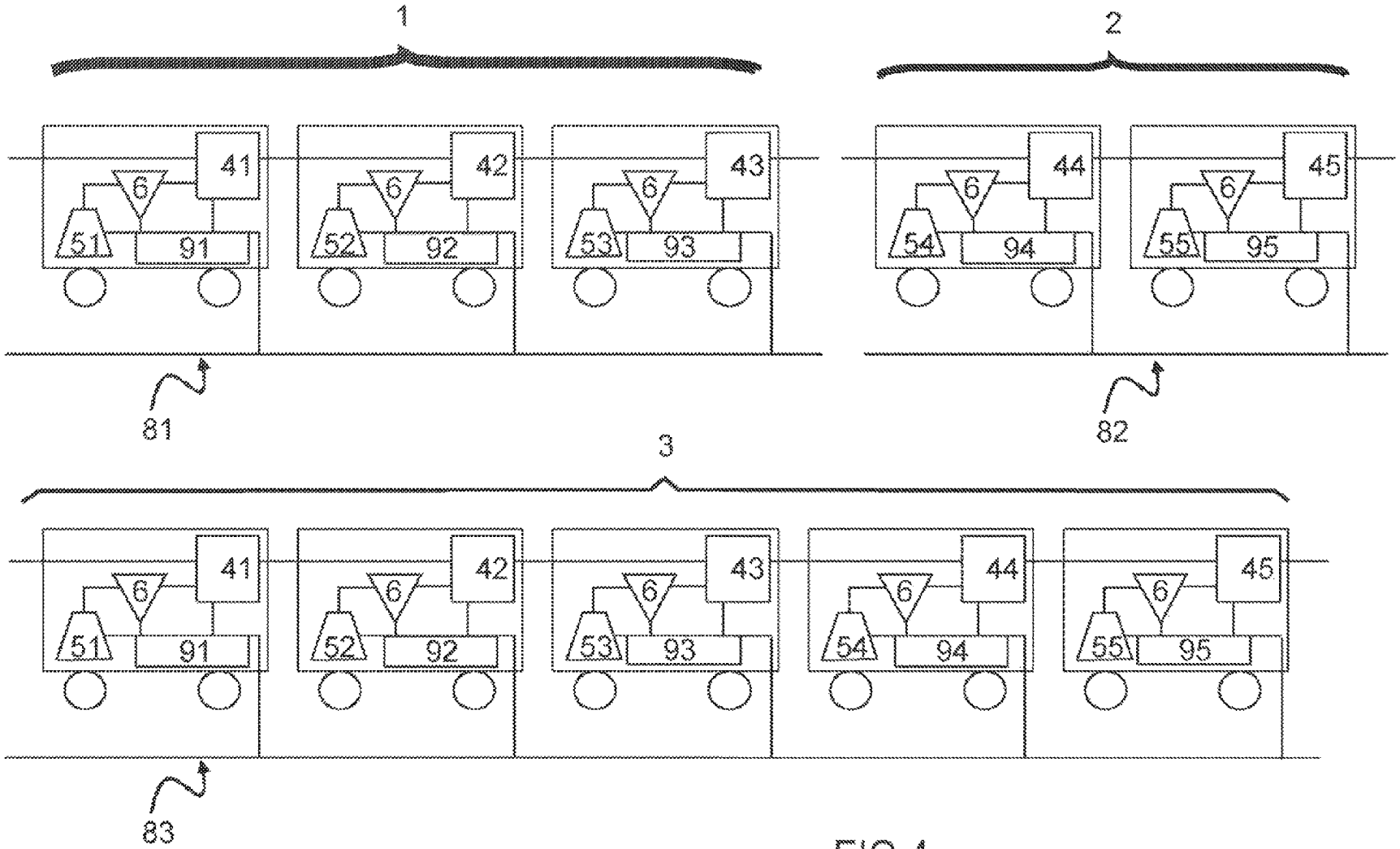
FIG. 4 Exemplary embodiment according to the invention of automatic coupling/splitting of units in a multi-unit vehicle.

FIG. 4 shows an automatic coupling of a first multi-unit vehicle 1 with a second multi-unit vehicle 2 each comprising a secure piloting system according to the invention, to form a new multi-unit vehicle. Before coupling, each of the two multi-unit vehicles, for example a first train comprising three carriages and a second train comprising two carriages, has its own distributed secure piloting system, each such secure piloting system of each of the multi-unit vehicles being independent of the other. The first multi-unit vehicle 1 comprises in particular three units, and the second multi-unit vehicle 2 comprises two units.

The piloting system of the first multi-unit vehicle 1 includes in particular at least three processors 51, 52, 53 and at least three input/output modules 91, 92, 93, connected by a first network 81, for example Ethernet, power line communication or Wi-Fi. Similarly, the second multi-unit vehicle 2 includes in particular at least two processors 54, 55 and at least two input/output modules 94, 95 connected by a second network 82. For each of the two multi-unit vehicles, at least one processor and at least one input/output module of the secure piloting system are intended to be fitted to a unit, such that each unit has at least one processor and at least one input/output module. Thus, in this example, each unit is an independent unit. However, said first and second multi-unit vehicles could also include one or more non-independent units, each non-independent unit comprising for example at least one input/output module and one identity generation device.

One of the processors 51, 52, 53 of the first multi-unit vehicle 1 is selected to be the master processor of the first multi-unit vehicle 1, for example the processor 51 that can be positioned at one end of said first multi-unit vehicle 1, and another of the processors 51, 52, 53 of the first multi-unit vehicle 1 could be selected to be the redundant processor thereof, for example the processor 53 that can be positioned at the other end of the first multi-unit vehicle 1. Similarly, one of the processors 54, 55 of the second multi-unit vehicle 2 is selected to be the master processor of the second multi-unit vehicle 2, for example the processor 54 that can be positioned at one end of the second multi-unit vehicle 2, and another of the processors 54, 55 of the second multi-unit vehicle 2 could be selected to be the redundant processor thereof, for example the processor 55 that can be positioned at the other end of the second multi-unit vehicle 2. In general, it is always preferable that the secure piloting system includes in particular a master processor that can be positioned, in particular in an independent unit, at one end of the multi-unit vehicle and a redundant processor of said master processor, i.e. the redundant processor thereof, that can be positioned, in particular in an independent unit, at the other end of said multi-unit vehicle, to enable said multi-unit vehicle to be split effectively.

The other processors of the first multi-unit vehicle 1, and respectively of the second multi-unit vehicle 2, are in an inactive state, for example the processor 52 of the first multi-unit vehicle 1. In general, the choice of the master processor and the redundant processor thereof may be based on a selection algorithm using numbering, such as an IP address or a processor number, or determination of a position of the processors in the multi-unit vehicle, said position being for example a central position, a head position or a tail position of the multi-unit vehicle, it being possible to determine the position of a processor using said composition datum. Preferably, for each of the piloting systems of the first and second multi-unit vehicles, at least one mechanism for securing and prioritizing a securing module of a processor of the piloting system is able to select said master processor and the redundant processor thereof, thereby enabling prioritization of the master processor, i.e. an exclusive connection of the master processor with the inputs/outputs of the input/output modules of the multi-unit vehicle, such that only the master processor is able to check the inputs/outputs of the input/output modules to be fitted to said multi-unit vehicle. The redundant processor is able to take control of said inputs/outputs in the event of failure of the master processor. For each multi-unit vehicle, said securing module able to implement said securing and prioritization mechanism may be chosen automatically as a function of said composition datum for each of said multi-unit vehicles. Preferably, the securing module is able to use its own securing and prioritization mechanism to select the processor it is intended to be fitted to as the master processor. Thus, the securing module is preferably able to prioritize the processor it is fitted to.

Thus, a securing module 6 of the first multi-unit vehicle 1 is able to select said processor 51 as master processor to enable this latter to check the inputs/outputs of the input/output modules 91, 92, 93 of the first multi-unit vehicle 1 via the first network 81. Similarly, a securing module 6 of the second multi-unit vehicle 2 is able to select said processor 54 as master processor to enable it to check the inputs/outputs of the input/output modules 94, 95 of the second multi-unit vehicle 2 via the second network 82.

Advantageously, each processor according to the invention, if it is the redundant processor of a master processor, is in particular able to check a synchronization state of its own context with a context of said master processor. Preferably, the master processor and the redundant processor thereof, when the context of this latter is verified as synchronous with the context of the master processor, can both be connected to the inputs/outputs of the input/output modules that can be associated with them. In particular, the securing module 6 of the master processor is able to lock, using an encoded association token, the connection of said master processor and the redundant processor thereof with said inputs/outputs. Preferably, when the master processor and the redundant processor thereof are connected via a locked connection to a set of inputs/outputs, only the master processor is authorized to control the functional devices of the multi-unit vehicle, while the redundant processor is able to check the operations performed by the master processor and to replace said master processor in the event of failure of this latter.

The piloting system of the first multi-unit vehicle 1 is also characterized in that it includes at least one identity generation device, in particular three identity generation devices 41, 42, 43, each intended to be fitted to one unit of the first multi-unit vehicle 1. Moreover, the piloting system of the second multi-unit vehicle includes two identity generation devices, each one intended to be fitted to a unit of said second multi-unit vehicle 2. Thus, a first identity generation device 41, a second identity generation device 42 and a third identity generation device 43 are each fitted to one unit of the first multi-unit vehicle 1, and a first identity generation device 44 and a second identity generation device are fitted to said second multi-unit vehicle. The identity generation devices 41, 42, 43 of the first multi-unit vehicle 1, and respectively those of the second multi-unit vehicle 2, can be connected one after the other to form a first chain of identity generation devices, and respectively a second chain of identity generation devices, each of said chains being in other words a first, and respectively a second, device for determining the composition of the multi-unit vehicle according to the invention. Each identity generation device is able to communicate and exchange data, in particular said list according to the invention, with the neighboring device or devices thereof. Identically as for the piloting system of the first or the second multi-unit vehicle, communication may be established from one end to the other of the identity generation device chain thereof or, in other words, from one end to the other of the multi-unit vehicle, either in a first direction from the head to the tail of the multi-unit vehicle, for example from the identity generation device 41 located at the head of the multi-unit vehicle to the identity generation device 43 located at the tail of said multi-unit vehicle, or vice versa, from the tail to the head of the multi-unit vehicle, for example from the identity generation device 43 at the tail to the identity generation device 41 at the head, or even in both directions at the same time. The same applies to the identity generation devices 44, 45 of the second multi-unit vehicle.

Advantageously, at least one of the identity generation devices 41, 42, 43 of the first multi-unit vehicle 1, and respectively of the second multi-unit vehicle 2, in particular located at an end of the first chain, and respectively of the second chain, is able to initialize said list according to the invention, for example a first list for the piloting system of the first multi-unit vehicle 1, and a second list for the second multi-unit vehicle 2. Each of these lists preferably includes a time datum, such as a date, and enables the composition of the multi-unit vehicle for which it has been generated to be encoded. Thus, it shall be possible to initialize the first list for the first multi-unit vehicle 1 using one of the identity generation devices thereof and it shall be possible to encode the composition of said first multi-unit vehicle 1, and it shall be possible to initialize a second list for the second multi-unit vehicle 2 using one of the identity generation devices thereof, and it shall also be possible to encode the composition thereof. For each of the piloting systems of the first and of the second multi-unit vehicles, once the first, and respectively the second, list has been initialized at one end of said first chain, and respectively second chain, of said first list, and respectively second list, is sent to another identity generation device in the direction of the other end of said first, and respectively second, chain such that it passes through the entire first, and respectively second, chain of identity generation devices. Each identity generation device 41, 42, 43 of the first multi-unit vehicle 1, and respectively each identity generation device 44, 45 of the second multi-unit vehicle 2, is able to add an identity datum to said first list, and respectively second list, after the last element (for example after the last identity datum) added to said first, and respectively second, list by the preceding identity generation device. The identity generation device located at the other end of said first chain, and respectively second chain, i.e. located at the end of the chain, is in particular able to transmit, notably cyclically, said first list, and respectively second list, encapsulated in a composition datum, to the master processor 51 and to the redundant processor 53 thereof via said first network 81 in the case of the first multi-unit vehicle 1, and to the master processor 54 and to the redundant processor 55 thereof, via said second network 82 in the case of the second multi-unit vehicle 2.

In particular, in the case of initialization of said list by each of the identity generation devices located at the end of the chain, i.e. a first initialization of a first list at one end of the chain and a second initialization of a second list at the other end of the chain, and propagation of each of the two lists in opposing directions in said chain of identity generation devices, the identity generation device liable to receive the first list via one of the connectors thereof and the second list via another of the connectors thereof is in particular able to create a new list comprising the elements of the first list, to which is added first of all the identity datum created by said generation device liable to receive the first and second lists, and then the elements of the second list. The new list therefore includes the identity data of all of the units making up the multi-unit vehicle. Alternatively, the identity generation device liable to receive the first list via one of the connectors thereof and the second list via another of the connectors thereof is able to select either the first list, or the second list, i.e. just one of the two lists, in order to send it to an identity generation device located at an end of the chain. Thus, although two lists are generated, only one of the two lists can be propagated to only one identity generation device located at an end of the chain, said device being responsible for creating the full list of the identity data of all of the units making up the multi-unit vehicle. Preferably, the identity generation device that created said new list is also able to encapsulate said new list in said composition datum so that it can be sent, in particular cyclically, to at least one processor, for example to all of the processors fitted to each of the multi-unit vehicles, or preferably to the master processor 51 and to the redundant processor 53 thereof.

If the first multi-unit vehicle 1 and the second multi-unit vehicle 2 are coupled to one another to form a new multi-unit vehicle 3 comprising the units of the second multi-unit vehicle 2 coupled after the units of the first multi-unit vehicle 1, an automatic reconfiguration procedure of the piloting system of the new multi-unit vehicle 3 can be performed automatically.

Indeed, when coupling two multi-unit vehicles together, if the identity generation devices are all identical and connectable to one another, it follows that the identity generation devices 41, 42, 43 of the first multi-unit vehicle 1 can be connected to the identity generation devices 44, 45 of the second multi-unit vehicle 2 in order to form a new chain of identity generation devices comprising the first chain connected to the second chain, thereby forming a new device for determining the composition of the new multi-unit vehicle 3. This new device for determining the composition of the new multi-unit vehicle 3 is able to automatically determine the composition of the new multi-unit vehicle 3 and to generate a composition datum encoding said composition of the new multi-unit vehicle 3. Moreover, when coupling a first multi-unit vehicle 1 to a second multi-unit vehicle 2, the first network 81 and the second network 82 can be connected together to form a new network 83, said new network 83 being a combination of the first network 81 and the second network 82.

The new device for determining the composition of the new multi-unit vehicle 3, formed by the identity generation devices of the first and of the second multi-unit vehicles, is able to send, via said new network 83, said composition datum of the new multi-unit vehicle 3 to all of the processors of the new multi-unit vehicle 3, in particular so that at least one securing module receives said composition datum. In particular, once said composition datum has been acquired by the processors 41 to 45 of the new multi-unit vehicle 3 and by the input/output modules 91 to 95 via said new network 83, the master processor 51 and the redundant processor 53 thereof of the first multi-unit vehicle 1, as well as the master processor 54 and the redundant processor 55 thereof of the second multi-unit vehicle 2 are able, using the securing module thereof, to disconnect themselves from the inputs/outputs of the input/output modules to which they were connected when the first and the second multi-unit vehicles were not coupled together, i.e. independent. Advantageously, each piloting system according to the invention is able, using said unlocking key sent by the respective securing modules thereof, to disconnect at least one of the processors thereof, in particular all of the processors thereof, from said set of inputs/outputs once a variation in said composition datum is detected. In particular, the securing module of the piloting system according to the invention is able to detect said variation in the composition datum and to disconnect at least one processor from said set of inputs/outputs, in particular the master processor and the redundant processor thereof, to enable a new master processor and the redundant processor thereof to take control of said inputs/outputs by connecting thereto.

Preferably, a new securing module 6, selected for example as a function of the composition datum of the new multi-unit vehicle 3, determines said new master processor and the redundant processor thereof. Preferably, the new master processor is located at one end of the new multi-unit vehicle 3, for example the processor 51, and the redundant processor thereof at the other end, for example the processor 55. The other processors 52, 53, 54 of the new multi-unit vehicle 3 are preferably in an inactive state.

The new securing module 6 of the piloting system of the new multi-unit vehicle 3 is then able, on the basis of said composition datum, to connect at least one processor, in particular said new master processor and the redundant processor thereof, to the set of inputs/outputs of the input/output modules 91 to 95 of the new multi-unit vehicle 3. Once the securing module 6 is able to check consistency between the inputs/outputs associated with the processors and the composition datum, the piloting system of the new multi-unit vehicle 3 is able to take control of said inputs/outputs in order to control the functional devices of the new multi-unit vehicle, enabling it to be piloted.

FIG. 4 shows the splitting of a multi-unit vehicle fitted with a secure piloting system according to the invention. When splitting a multi-unit vehicle, for example said new multi-unit vehicle 3, into two or more other multi-unit vehicles, for example into a first multi-unit vehicle 1 and a second multi-unit vehicle 2, said new chain of identity generation devices of said new multi-unit vehicle formed by the identity generation devices 41 to 45 is broken, separated into two parts, for example into said first chain of identity generation devices 41 to 43 of the first multi-unit vehicle 1, and said second chain of identity generation devices 44, 45 of the second multi-unit vehicle 2. Similarly, the network 83 of the new multi-unit vehicle 3 is separated into a first network 81 of the first multi-unit vehicle 1 and a second network 82 of said second multi-unit vehicle 2.

After splitting, each of the two parts of the chain of identity devices of the new multi-unit vehicle 3 is able to independently and automatically generate a new composition datum characterizing respectively the first multi-unit vehicle 1 and the second multi-unit vehicle 2. As before with the coupling of two multi-unit vehicles, the new composition datum is in particular able to trigger generation of the unlocking key by at least one securing module to enable each of the processors to be disconnected from the inputs/outputs to which they were previously connected in the configuration of said new multi-unit vehicle 3. Advantageously, said unlocking key can be sent to each securing module of a secure piloting system according to the invention, such that each securing module is able to disconnect a processor from the connection thereof with at least one input/output when said splitting occurs. In particular, the master processor 51 and the redundant processor 55 thereof can be disconnected from the inputs/outputs of the input/output modules 91 to 95 thereof using said unlocking key, which can be provided by the securing module, either during said detection of the variation of the composition datum during splitting, or during a process prior to notification of the splitting to said piloting system of said new multi-unit vehicle.

In another example, in particular if said splitting is not notified to said piloting system of said new multi-unit vehicle 3, and if the securing module 6 detects, before it detects said variation of said composition datum, a loss of connection of the master processor with the inputs/outputs of the input/output module or modules to which it was previously connected before splitting, this loss of connection may be interpreted by said securing module and the input/output module as a failure that could in particular trigger re-initialization of the confirmation message. This re-initialization of the confirmation message enables the connection of a new master processor selected following splitting for each of the first and second multi-unit vehicles to the inputs/outputs of the input/output module fitted to the units thereof.

In relation to the prior art, in which the master processor is liable to enter a safe loop state if a loss of connection with some of the inputs/outputs of the input/output modules of the unhitched units is detected, the present invention enables, when splitting or coupling, the automatic correlation of the new composition of the multi-unit vehicle with the set of inputs/outputs to be taken into consideration by the master processor, such that a loss of a connection between the master processor and any of the inputs/outputs thereof does not trigger activation of an emergency procedure in the piloting system.

For a multi-unit vehicle comprising several independent units, at least one processor from the set of processors distributed over the network of said vehicle can act as master processor to pilot said vehicle and to be linked directly, by connection to said set of inputs/outputs, to the input/output modules of said vehicle. When the processor acting as master processor is piloting said vehicle, the other processors of said vehicle may in particular be in standby mode, such that only the processor identified as master processor by the securing module is piloting said vehicle, and preferably the securing module identifies the processor it is fitted to as master processor.

Finally, the present invention makes it possible to describe a secure piloting system able to independently determine the composition of a multi-unit vehicle such as a train, and to securely check the correct connection of at least one processor of the piloting system with a set of inputs/outputs of input/output modules distributed over the network of said multi-unit vehicle.

The secure piloting system is in particular secured by checking, in particular cyclically, the consistency between the set of inputs/outputs that can be connected and locked to said processor and the composition of the multi-unit vehicle determined from the composition datum provided by said device for determining the composition of the multi-unit vehicle. In particular, composition data from said multi-unit vehicle able to describe a set of features of the units which could make up said multi-unit vehicle, and a set of possible configurations of said multi-unit vehicle may be used as reference for checking, in particular cyclically, the consistency between the set of inputs/outputs that can be connected and locked to said processor and the composition of the multi-unit vehicle.

Advantageously, the present invention enables the integrity of a multi-unit vehicle to be checked without using application-level data, such as position, and provides greater processing genericity on account of direct access to the set of inputs/outputs of the multi-unit vehicle and the option of centralizing software processing related to securing of the piloting system on a single processor.

In summary, the method and the system for securing a piloting system according to the invention have several advantages over existing methods and systems in that:

- they enable securing of the determination of the composition of a multi-unit vehicle to be independent: determination of the composition is independent of the application software in the processors used for automatic piloting;
- they permit dynamic modification of the composition of a train without interrupting the safe monitoring of the composition of said multi-unit vehicle;
- they enable SILO usage of the distributed and dynamically reconfigurable secure piloting system;
- the securing and prioritization mechanism enables an exclusive attribution of the connection of a set of inputs/outputs to at least one processor, in particular one processor only, and makes it possible to securely and directly associate a master processor with secure outputs. This enables a dynamically reconfigurable distributed architecture to be used, thereby enabling operating data to be centralized and making deployment more flexible;
- they make it possible to continuously determine the composition of the multi-unit vehicle and a locking state of the inputs/outputs with the master processor. In particular, updating of the composition datum is compatible with the transmission period of the confirmation message intended to refresh the inputs/outputs connected to the master processor;
- centralization of data in one processor simplifies the automatic piloting system, thereby reducing the complexity of security analyses. Piloting of the multi-unit vehicle by a processor via input/output modules is thereby secured;
- they enable a unit to be automatically added to or removed from a multi-unit vehicle.

The invention claimed is:

1. A method of securing a piloting system to be fitted to and to pilot a multi-unit vehicle, the method which comprises:

independently determining a composition of a multi-unit vehicle by a device for determining the composition of the multi-unit vehicle correlated to a generation of a composition datum of the multi-unit vehicle;

transmitting the composition datum to a set of elements of the piloting system, wherein at least one element of the set of elements is a processor of the piloting system;

determining, by the processor using the composition datum, a set of inputs/outputs of at least one input/output module intended to be fitted to the multiunit vehicle;

and connecting with a securing and prioritization mechanism each element of the set of elements to the set of inputs/outputs.

2. The method according to claim 1, wherein the set of elements includes a processor group.

3. The method according to claim 2, which comprises implementing the securing and prioritization mechanism for the connection of at least one processor of the processor group to the set of inputs/outputs.

4. The method according to claim 3, wherein the securing and prioritization mechanism includes generating an encoded association token able to lock the connection of at least one processor of the processor group with the set of inputs/outputs, and generating an unlocking key able to unlock the connection of at least one processor of the processor group with the set of inputs/outputs.

5. The method according to claim 1, which comprises cyclically, or sufficiently frequently, checking a consistency between the connection of each element of the set of elements with the set of inputs/outputs and the composition datum.

6. The method according to claim 1, wherein the step of independently determining includes a successive and ordered addition to a list, in an order of composition of the multi-unit vehicle, of at least one identity datum of each unit of the multi-unit vehicle, such that an order of succession of identity data included in the list can be correlated with the order of composition of the units of the multi-unit vehicle, each identity datum being specific to a single unit of the multi-unit vehicle, and it being possible to encapsulate the list within said composition datum.

7. A secure piloting system of a multi-unit vehicle, the system comprising:

a device for determining a composition of the multi-unit vehicle, said device being configured to independently determine the composition of the multi-unit vehicle and to generate a composition datum that can be correlated with the composition of said multi-unit vehicle;

at least one processor including at least one securing module, said processor being configured to be fitted to at least one unit of the multi-unit vehicle, each processor being connectable by way of at least one connection and via a network, firstly to a set of inputs/outputs of input/output modules intended to be fitted to one or more units of the multi-unit vehicle, and secondly to said device for determining the composition of the multi-unit vehicle, in order to exchange, via each input/output module, operating data on the respective said unit and/or the multi-unit vehicle, and in order to acquire from said determination device a composition datum on said multi-unit vehicle;

said dynamic securing module of said connection of each processor with said set of inputs/outputs, said securing module being configured to determine, using the composition datum, said set of inputs/outputs that can be connected to each processor, to connect each processor to said set of inputs/outputs, and to check consistency between each connection of each processor to said set of inputs/outputs.

8. The piloting system according to claim 7, further comprising a processor group, and wherein said securing module is configured to prioritize the connection of a single processor of said processor group to said set of inputs/outputs.

9. The piloting system according to claim 7, wherein said securing module includes a locking module capable of locking each connection of said processor with each of the inputs/outputs of said set of inputs/outputs.

10. The piloting system according to claim 9, wherein said locking module includes an encoded association token generator able to generate an encoded association token in order to lock each connection of said processor with each of the inputs/outputs of said set of inputs/outputs and an unlocking key able to unlock at least one connection of said processor with at least one of the inputs/outputs of said set of inputs/outputs.

11. The piloting system according to claim 7, wherein said device for determining the composition of the multi-unit vehicle includes at least one identity generation device, each identity generation device of said determination device being configured for fitting to a respective unit of the multi-unit vehicle, each identity generation device being able to generate an identity datum of the unit it is fitted to.

12. An identity generation device for enabling a determination of a composition of a multi-unit vehicle having at least one unit, wherein the identity generation device is designed to be fitted to a unit of the multi-unit vehicle and the identity generation device comprises:

an identity data generator configured to generate an identity datum of the unit to which the identity generation device is to be fitted, said identity datum being intended to enable identification of said unit;

a connection detector configured to detect a presence or absence of a coupling of said identity generation device to at least one other identity generation device;

a list generator configured to create a list, cyclically or with sufficient frequency, of elements intended to include elements that can be ordered and added successively;

a serialization component capable of adding another element to said list, either after a last element of a list of elements that can be ordered successively and that is designed to be received by said identity generation device, or as the first element of the list of elements that can be created by the list generator, said other element including said identity datum;

and a list transmitter configured to send the list of elements including said other element either to another identity generation device, or to at least one processor of the multi-unit vehicle, following encapsulation of the list within a composition datum of the multi-unit vehicle.

13. The device according to claim 12, wherein said identity generation device includes at least two connectors, including a first connector and a second connector, said connectors being configured to couple the identity generation device to another identity generation device.

14. The device according to claim 13, wherein said identity data generator is configured to generate a polarization datum able to authorize the transmission of the list of elements using only one of said two connectors.

* * * * *